US005201132A

United States Patent [19]

Jacob

[11] Patent Number: 5,201,132

[45] Date of Patent: Apr. 13, 1993

[54] STRIP COOLING, HEATING OR DRYING APPARATUS AND ASSOCIATED METHOD

[75] Inventor: William L. Jacob, Pittsburgh, Pa.

[73] Assignee: Busch Co., Pittsburgh, Pa.

[21] Appl. No.: 691,708

[22] Filed: Apr. 26, 1991

[51] Int. Cl.[5] ..... F26B 7/00

[52] U.S. Cl. ..... 34/13; 34/62; 34/156; 34/160

[58] Field of Search ..... 34/155, 156, 151, 160, 34/62, 13, 12, 18, 20, 23, 60

[56] References Cited

U.S. PATENT DOCUMENTS

| | | | |
|---|---|---|---|
| 3,048,383 | 8/1962 | Champlin | 34/156 |
| 3,068,586 | 12/1962 | Vaughan et al. | 34/62 |
| 3,199,224 | 8/1965 | Brown | 34/156 |
| 3,777,408 | 12/1973 | Marchal | 34/156 |
| 4,406,388 | 9/1983 | Takashi et al. | 34/156 |
| 4,505,050 | 3/1985 | Jung et al. | 34/160 |
| 4,625,431 | 12/1986 | Nanba et al. | 34/62 |
| 4,750,715 | 6/1988 | Harada et al. | 34/156 |
| 4,785,985 | 11/1988 | Hürtgen | 34/156 |

OTHER PUBLICATIONS

Metal Producing, Jul., 1990, pp. 33, 53.

Jet Impingement Heat Transfer From Jet Tubes and Orifices, Natl. Heat Transfer Conference, 1989, HTD—vol. 102, pp. 43-50.

*Primary Examiner*—Henry A. Bennet

*Assistant Examiner*—Denise L. F. Gromada

*Attorney, Agent, or Firm*—Arnold B. Silverman

[57] ABSTRACT

Apparatus for cooling, heating, wiping, or drying a strip such as a metal strip has either a first cooling unit employed alone or first and second cooling units disposed in relative spaced relationship with a path therebetween for movement of the strip. Each air handling unit has a hollow body portion and a plurality of elongated projecting gas discharge nozzles. The first and second air handling units respectively discharge gas on the surfaces of opposite sides of the strip and also serve to define a spent gas exhaust region. The system may also be employed to resist undesired strip instability. An associated method is provided.

44 Claims, 3 Drawing Sheets

STRIP COOLING, HEATING OR DRYING APPARATUS AND ASSOCIATED METHOD

BACKGROUND OF THE INVENTION

1. Field of the Invention

The present invention relates to a cooling, heating or drying system for strips of material such as metal strips and, more specifically, it relates to such a system which is adapted for high speed, thermally efficient processing of metal strip.

2. Description of the Prior Art

It has long been known that for many purposes a combination of materials may provide an advantageous blend of properties for a given product. Among such combinations are the coating of steel strip with a relatively thin layer of zinc in a galvanizing process.

In respect of continuous galvanizing, a steel coil provides a continuous strip which is, in one embodiment, immersed in a molten bath of zinc, is passed through a furnace and is subsequently cooled prior to recoiling. Various types of cooling means for such systems have been known. See, generally, Metal Producing, July, 1990, pages 33, 53.

It has been known in the galvanizing art to employ elongated cooling tubes having longitudinal slots therein. Such tubes are positioned relatively close to the strip being cooled, e.g., on the order of about 5 inches. A number of problems have arisen from such constructions. More specifically, the close proximity of the slots to the strip has resulted in inefficient air flow as the spent gas which has already had contact with the strip surface tends to be re-entrained or interfere with efficient flow of the cooling gas from the slots to the strip surface. Also, occasionally either the strip or the slotted tube would be damaged as a result of undesired contact therebetween.

A general disclosure of the use of plates with orifices or jet tubes in heating, cooling, or drying of various industrial products is contained in Jet Impingement Heat Transfer From Jet Tubes in Orifices, National Heat Transfer Conference, 1989, HTD-Vol. 107, pages 43–50. While not specifically directed toward the cooling of metal strip, the concept of multiple jets for impinging air on a plate and exhausting such air is discussed.

A further problem encountered in respect of cooling lines for galvanized steel process systems, is the fact that the desire for increased productivity has resulted in the need for enhanced cooling systems, but existing plant structures frequently are not adequately sized to permit installation of the equipment needed for such enhanced cooling.

There remains, therefore, a very real and substantial need for improved cooling, heating and drying systems for elongated strip materials such as may be employed in metal strip lines, such as galvanizing lines.

SUMMARY OF THE INVENTION

The present invention has provided a system for improved treatment of strip as by cooling such metal strip which has been subjected to galvanizing, or by heating, or wiping, or drying metal strip.

In a preferred form of the cooling apparatus, first and second units are disposed in relative spaced relationship with a path for travel of the strip being disposed therebetween.

The first unit and the second unit each have a hollow body portion and a plurality of elongated projecting nozzle elements extending toward the other unit.

Means are provided for introducing gas such as air to the hollow body portions to cause the gas to impinge upon both sides of the strip. The apparatus contributes to efficient thermal transfer at the strip by providing regions adjacent to the projecting nozzles for exhaust of spent gas. Depending upon the temperature and air velocity the system can be employed to cool, heat or dry the metal strip.

A number of preferred relationships in respect of the nozzles as related to the metal strip are provided. A corresponding method is provided.

It is an object of the present invention to provide a strip treatment system which facilitates efficient uniform cooling, heating or drying and rapid withdrawal of the spent gas to avoid thermal contamination of such gas supplied to the strip surface by the projecting nozzle elements.

It is a further object of the present invention to provide such a system wherein a spent gas receiving region facilitates ready discharge of the gas which has had heat exchanging contact with the strip.

It is a further object of the present invention to provide such a cooling system for galvanized steel strip lines which effectively controls the rate of cooling so as to avoid undesired transfer of strip coating to the turnover rolls which are used to direct strip travel and support the strip.

It is another object of the present invention to provide such a system which may be provided in a relatively small space.

It is yet another object of this invention to provide such a system which eliminates the undesired problems encountered with plate orifices and slotted tubes of the prior art.

It is an object of this invention to provide such a system which has high velocity cooling gas flow combined with a low pressure impedance cooling system.

It is yet another object of the present invention to provide uniform heat transfer over the surface of the strip.

It is yet another object of the present invention to provide such a system which maximizes heat transfer by producing conditions at the surface of the strip which facilitate the desired transfer.

It is another object of the present invention to provide such a system which resists undesired lateral strip movement, noise and vibration caused by the gas flow.

It is another object of the present invention to provide such a system which is adapted for use with a large variety of strip widths.

It is further object of the invention to provide such a system which employs low volume cooling gas flow for a given rate of heat transfer as compared to the volumetric flow required by systems employing prior art devices.

It is a further object of the present invention to provide such a system for use in heating, wiping, or drying metal strip.

These and other objects of the invention will be more fully understood from the following detailed description of the invention on reference to the illustrations appended hereto.

DESCRIPTION OF THE PREFERRED EMBODIMENTS

Figure 1:
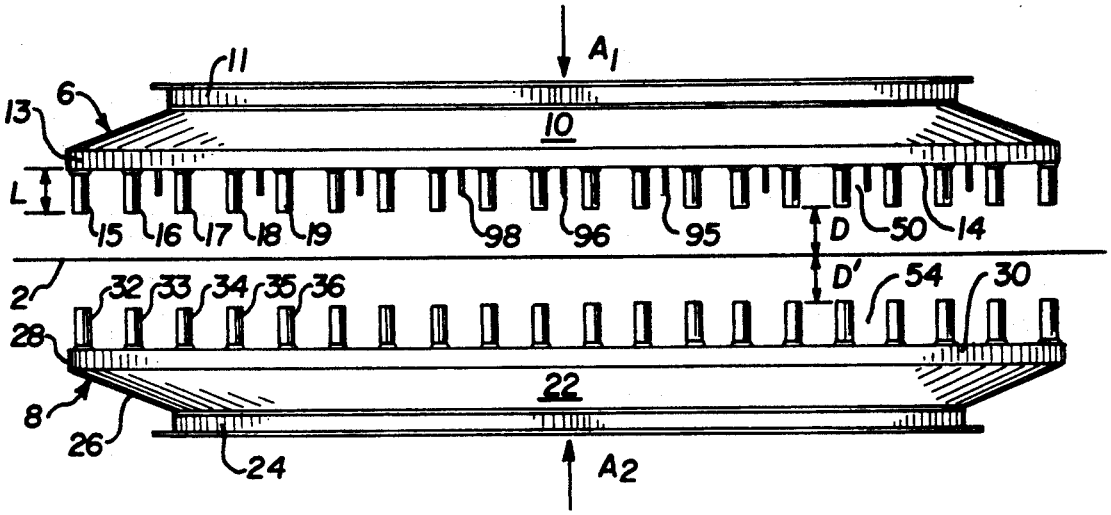
FIG. 1 is a partial front elevational view of a form of apparatus of the present invention.
Figure 2:
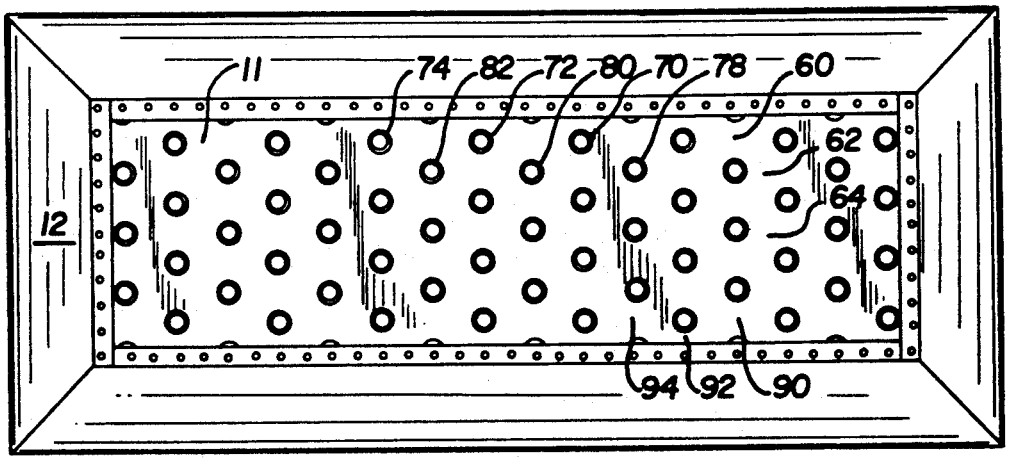
FIG. 2 is a partial top plan view of a unit of the apparatus shown in FIG. 1.
Figure 3:
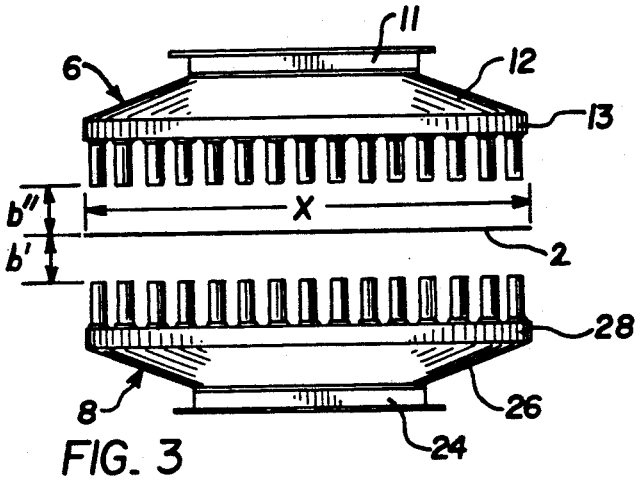
FIG. 3 is a right side elevational view of the apparatus shown in FIG. 1.

Referring now more specifically to FIGS. 1 through 3 there is shown a preferred embodiment of the apparatus. In general, it is conventional after immersing steel strip in zinc to have the strip travel vertically through an annealing furnace and then be transported vertically and horizontally through a cooling zone.

In the form shown, the galvanized steel strip 2 is traveling in a linear path between first cooling unit 6 and second cooling unit 8. The first cooling unit 6 has a hollow body portion or plenum 10 which is open upwardly and is adapted to cooperate with means such as a fan for establishing the flow of the cooling gas such as air. The plenum 10 has a throat 11 which defines a gas receiving opening, a diverging transition wall 12, a sidewall 13 and a front wall 14. In the alternative, a box type entry without the diverging portion or other desired plenum shape could be employed.

The means for establishing gas flow will generally be a fan which may be directly secured to the upper portion of plenum 10 or may be connected thereto by appropriate ductwork (not shown). The former approach provides the benefit of eliminating the need for ductwork. The latter approach permits insertion in the duct of gas temperature altering means such as cooling or heating units, if desired. All that is required is that a portion of the upward opening of the plenum be closed off as by a suitable sheet metal section and that a fan suitably sized in accordance with procedures well known to those skilled in the art be secured thereto. Disposed under the plenum 10 and in communication therewith are a plurality of elongated downwardly projecting nozzles, a sampling of which has been numbered 15 through 19. Gas to be delivered through the nozzles enter plenum 10 in the direction indicated by arrow $A_1$. These nozzles are preferably tubular and have a generally circular configuration with an internal diameter of about 1 inch to 4 inches and preferably about 1½ to 2½ inches. They preferably have a length L of about 3 to 12 inches. The nozzles have an upper end secured to and communicating with the plenum 10 and a lower discharge end which is spaced a distance D from the upper surface of the strip 2. Second cooling unit 8 has a plurality of elongated upwardly projecting nozzles, a sampling of which has been numbered 32 through 36. Gas to be delivered through the nozzles of unit 8 enters plenum 22 in the direction indicated by arrow $A_2$. A distance D' which is preferably equal to distance D exists between the free ends of the nozzles of cooling unit 8 and the strip 2. The spacing b', b'' (FIG. 3) between the strip and the free end of the nozzles is preferably about 3 to 7 times the nozzle internal diameter.

Plenum 22 has a throat 24, a diverging transition wall 26, a sidewall 28, and a front wall 30. The plenum 22 is operatively associated with the upwardly projecting elongated nozzles. In the preferred embodiment, the second cooling unit 22 will have generally the same number of nozzles of the same shape and size as the first cooling unit 6.

It will be appreciated that cooling gas emerging from the nozzles of the two cooling units 6, 8 will impinge upon opposite sides of the strip 2 to effect cooling from both sides. There may be instances where it is not desired or not practical to have both sides of the strip be impinged on by gases issuing from extended nozzles for the purpose of cooling. In those cases only one side would be impinged on, resulting in less overall heat transfer per unit area; however, what heat transfer there is can be most optimum for conditions. There are also instances which affect strip stability and vibration where the impingement on the opposite sides of the strip will differ in gas velocity and/or volume.

Figure 6:
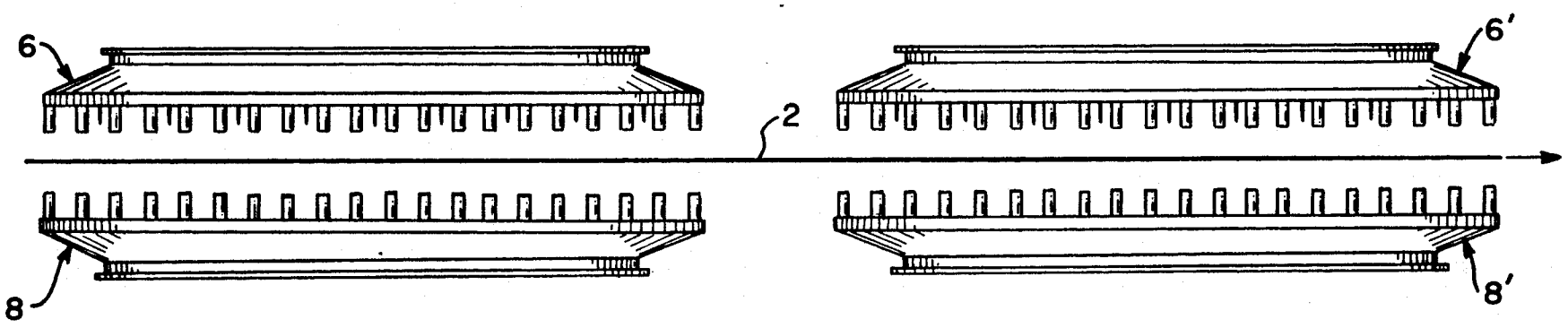
FIG. 6 is a partial front elevational view similar to FIG. 1 but showing two pairs of handling units.

It will be appreciated that while FIGS. 1 through 3 illustrate a single pair of units, in general, installations will have a plurality of such pairs of units disposed along the path of strip travel in relative generally aligned relationship. In the embodiment of FIG. 6 the strip 2 travels in the direction of the arrow between the first units 6, 8, and then between the second units 6', 8'. In such installations, in lieu of or in addition to velocity variations from side to side within a pair of units, a selected unit or number of units on one or both sides of the strip may be turned off, i.e., zero velocity in order to achieve the desired strip stability and/or strip positioning along its path of travel through the cooling zone.

The cooling gas will preferably be at an atmospheric ambient temperature unless that is objectionable for personnel health and safety due to climatic conditions.

It is desired to provide a high coefficient of thermal transfer between the gases and the surfaces of strip 2. This is accomplished by employing a relatively low volume, high velocity delivery of the gas from the nozzles to the strip 2. In a preferred embodiment, the velocity of the cooling gas, which may be at ambient temperature, is about 1,000 to 13,000 feet per minute and preferably about 8,000 to 13,000 feet per minute with each unit having about 100 to 250 nozzle members. For example, a velocity of about 10,000 feet per minute producing a volume of air at 218 cubic feet per minute with 2 inch internal diameter nozzles may be used. These ranges provide good heat transfer, energy efficiency and maintenance of strip stability, by resisting aerodynamically induced strip vibrations.

It will be appreciated that the gas emerging from the nozzles will provide efficient heat transfer on the strip by establishing a thin boundary layer of gas as the gas impinges on the strip with subsequent turbulent interactive mixing when flow of the boundary layers created by each nozzle collides with similar flow from other nozzles.

In the preferred practice of the present invention, the spaces between the exteriors of the nozzles on first cooling unit 6 (which space shall generally be designated 50) provide a region between the free ends of the nozzles and the front surface 14 of the plenum 10 which will serve to facilitate exhaust of spent gas. This results in efficient flow of the cooling gas emerging from the nozzles over the full surface of the metal strip 2. The spent gases will move through zone 50 and outwardly to be exhausted. Similarly, zone 54 of the second cooling unit 8 cooperates with surface 30 to provide for exhaust in the corresponding region. By providing this efficient flow path from nozzle to strip 2 to exhaust in combination with other preferred features of the present invention a high coefficient of thermal transfer is obtained.

In the use of the system of this invention in cooling strip, the flow of spent gas over the exterior of the nozzles in spaces 50, 54 and over the surfaces 14, 30 of plenums 10, 22, respectively, serves to withdraw heat created in these portions of the system due to heat radiating from the hot strip.

Referring to FIG. 2, it is shown that in a preferred embodiment the nozzles are contained within a plurality of rows such as row 60, row 62, and row 64. In the preferred practice of the invention, the nozzles of one row such as nozzles 70, 72, 74 of row 60 will be in staggered relationship with respect to the nozzles of the next adjacent row such as nozzle 78, 80 and 82 of row 62. This facilitates obtaining more uniform coverage of the strip by the cooling gases. Similarly, with respect to cross rows such as 90, 92, 94 nozzles in adjacent rows are also staggered.

While the system may employ any desired number of nozzles and the number used will depend in part upon the internal diameter selected for the nozzle elements, it will generally preferable to have nozzle elements positioned at a center-to-center spacing of 4 to 5 times the nozzle internal diameter.

The strip will generally have a thickness of about 0.02 to 0.10 inch and most commonly have a thickness of about 0.045 inch, although these dimensions are not limiting of the invention. The strip travel may be about 250 to 450 feet per minute within the zone.

The strip may have a width on the order of about 24 to 72 inches which maximum dimension is indicated by the dimension X in FIG. 3. Where strips of lesser width are employed, while not essential, it may be desirable as to those nozzle elements which are disposed transversely outwardly of the strip and thereby directly confronting each other without the strip 2 serving as a barrier, to provide either a barrier or through inserts in the nozzles or other means reduce the flow output of those nozzles so as to minimize the likelihood of creating undesired vibrations and noise within the strip 2. Thin strips can be aerodynamically induced to vibrate in an undesired manner at various of their modal frequencies (typically 1st and 2nd ) at virtually any gas velocity (high or low) as long as the velocity and distribution on both sides of the strip are uniform or nearly uniform. This kind of vibration will tend to travel the length of the strip into zones where there is no air impingement. This condition can adversely affect the control of zinc coating of the strip at the air knives. It could also affect the uniformity of coating. In these instances it will be desirable to provide a higher gas velocity on one side of the strip than on the other. A practical way this can be accomplished is by flow reduction on one side of the strip such as by damper adjustment or motor speed control, for example. This change in velocity causes the strip to deflect away from the high velocity side toward the low velocity side. The deflection will be along the length of the strip and is not noticeable across the strip. The velocity differential required will vary with strip thickness and strip tension. For a typical strip which is susceptible to aerodynamically induced vibration, a velocity pressure differential greater than approximately 3" water gage across the strip will produce virtual stability.

If simple strip deflection by strip deviation from a straight tangent line from the bottom roll to the top turnover roll is not acceptable at the entrance to the cooling zone, then a compound strip deflection can be produced within the cooling zone which maintains the original strip position at the entry to the cooling zone. This can be accomplished by properly adjusting the nozzle discharge velocity of selected units on one or both sides of the strip and/or deactivating selected units that a strip susceptible to aerodynamically induced natural frequency vibration across the strip should be taken out of the neutral force field created by equal forces produced by opposed nozzles on opposite sides of the strip by means of aerodynamically produced strip deflection. The force necessary to produce the critical amount of strip deflection or loading which stabilizes the strip can be provided without physical contact between the strip and the rolls which can damage the hot zinc coating on the surface of the strip. These forces are produced by adjusting the total pressure generated by gas impingement on the strip. These forces enable the strip to resist destabilizing aerodynamic forces. The deflection can be simple or compound as long as it generates the resistive strip loading necessary. Simple and compound deflection results in the elimination of undesired vibration of strips having thicknesses and widths which could otherwise vibrate in a mode of their natural frequency. Compound strip deflection results in guiding the strip along a desired path from both the top and bottom rolls through the furnaces and cooling zone.

By way of example, when the preferred nominal nozzle velocity is 10,000 feet per minute, and strip deflection is required to eliminate strip vibration, a velocity pressure differential greater than 3" w.g. can be achieved when there is 12,000 fpm through the nozzles on one side of the strip and 9,500 fpm through the nozzles on the other side of the strip. This also retains good heat transfer.

Another approach would be to position one cooling unit or the other in such a manner to permit it to be moved toward or away from the strip 2 so as to alter the cooling gas flow in regions where the strip does not serve as a barrier between aligned nozzles. It will generally be the objective to have the strip cooled within the zone from a temperature of about at least 1,000° F. to about 700° F. or less within the cooling zone, although temperature is not a limitation on the invention.

The rate of cooling should be controlled carefully. Cooling that is inadequate could produce surface defects when the strip contacts the turnover roll. Cooling that is inadequate could also produce a zinc coated topturnover roll which could damage the zinc coated surface on the roll contact side of the strip.

In order to impose uniform gas induced forces on the strip 2, it is preferred to have the nozzles of one cooling unit generally axially aligned with the nozzles of the other cooling unit.

As shown in FIG. 1, a series of elongated stiffener members such as members 95, 96, 98 are preferably provided on the front wall 14 of first cooling unit 6. Similar elongated stiffener members (not shown) are preferably provided on front wall 30 of second cooling unit 8. The stiffener members of one of the units are preferably oriented generally parallel with respect to the other stiffeners on that unit and are preferably generally coextensive with the nozzle array.

Figure 4:
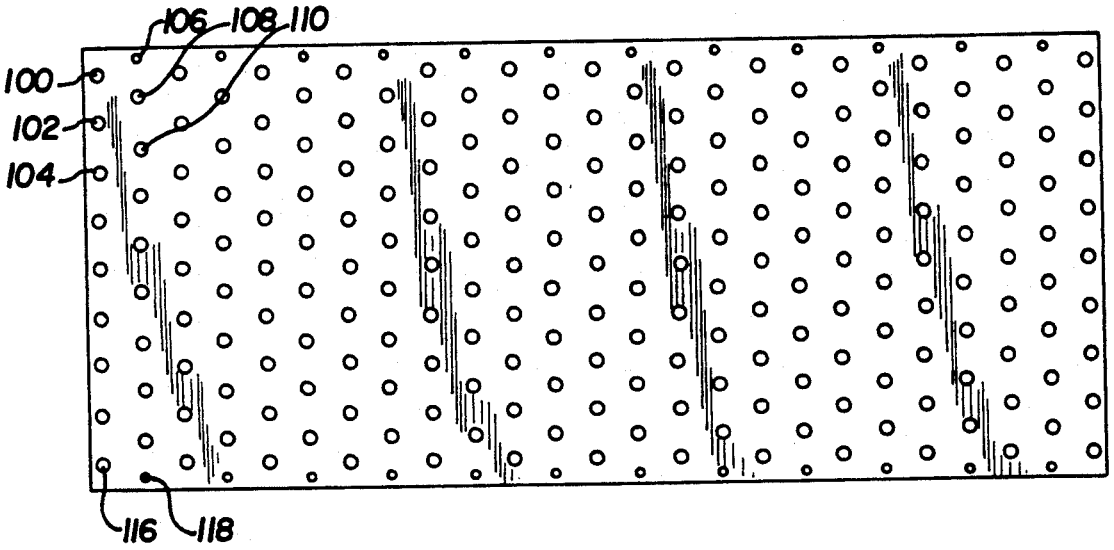
FIG. 4 is a front elevational view of one of the units of the present invention.

FIG. 4 shows an elevational view of one cooling unit as viewed from the strip side. It will be appreciated that a plurality of nozzles such as 100, 102, 104, 106, 108, 110 are disposed in rows and are staggered with respect to next adjacent rows. It is preferred that the center of the nozzle of one row be aligned with the midpoint between two nozzles in the next row of the same unit. The staggered array between rows 116 and 118 is preferably such that taking two nozzles from one row and one from the other, the three will be equally distant from each other thereby forming an equilateral triangle.

Figure 5:
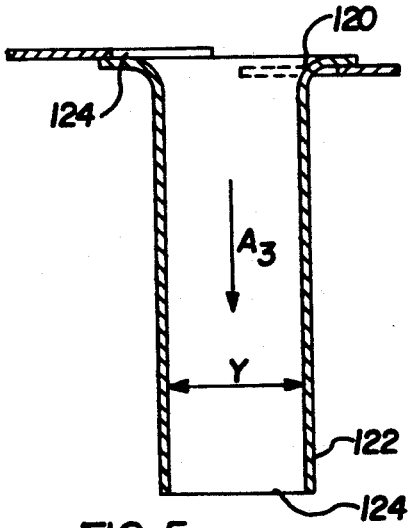
FIG. 5 is a cross-sectional illustration of one of the nozzle elements of the present invention.

Referring to FIG. 5, there is shown a cross-section of a typical nozzle which has an internal diameter Y which is preferably on the order of about 1½ inches to 2½ inches. The nozzle has one end 120 in communication with the plenum and a free end 122 defining an opening 124 for gas discharge. The plenum end 120 of the nozzle has an annular outwardly flared portion 124 which has a generally bell-shape to facilitate a smooth transition in respect of gas flow in the direction indicated by arrow $A_3$ from the plenum to the interior of the nozzle.

direction transversely to the longitudinal extent of the strip.

In the form illustrated and in the preferred practice of the invention, the path of flow of the cooling gas within the nozzles will be in a direction generally perpendicular to the surface of the strip 2. There may be special instances where some or all of the nozzles are to be placed angularly as distinguished from perpendicularly with respect to the strip 2.

EXAMPLE

In order to provide further details regarding the invention, an example will be provided. Apparatus of the invention was provided such that a first cooling system of the type shown in FIGS. 1 through 3 was followed downstream by a generally identical second cooling system. This effects two stages of strip cooling, As shown in the table, the degree of cooling in the first cooling system ranged from an initial temperature of 1,000° F. to about 1100° F. to a reduced temperature of about 700° F. In the second cooling system, the temperature entering is about 700° F. and the exiting temperature ranged from about 275° F. to about 350° F.

TABLE

| VARIABLES | 1 | 2 | 3 | 4 | 5 | 6 |
|---|---|---|---|---|---|---|
| STRIP THICKNESS (IN.) | 0.03 | 0.035 | 0.04 | 0.045 | 0.05 | 0.055 |
| STRIP WIDTH (IN.) | 72 | 72 | 72 | 60 | 30 | 48 |
| COOLING AIR TEMP (DEG F.) | 100 | 70 | 125 | 100 | 110 | 100 |
| STRIP SPEED (FPM) | 600 | 625 | 575 | 650 | 500 | 450 |
| COOLER NO. 1 | | | | | | |
| STRIP TEMP INTO COOLER | 1050 | 1050 | 1000 | 1000 | 1100 | 1050 |
| STRIP TEMP OUT OF COOLER | 700 | 700 | 700 | 700 | 700 | 700 |
| COOLER NO. 2 | | | | | | |
| STRIP TEMP INTO COOLER | 700 | 700 | 700 | 700 | 700 | 700 |
| STRIP TEMP OUT OF COOLER | 350 | 350 | 300 | 275 | 300 | 325 |
| COOLER NO. 1 | | | | | | |
| COOLER LENGTH (~FT) | 35 | 40 | 40 | 49 | 53 | 46 |
| TOTAL CFM/2 SIDES | 185901 | 215266 | 213609 | 217421 | 117991 | 165446 |
| COOLING RATE (DEG F./SEC) | 100.53 | 90.43 | 71.87 | 66.51 | 62.85 | 56.48 |
| COOLER NO. 2 | | | | | | |
| COOLER LENGTH (~FT) | 66 | 74 | 113 | 148 | 116 | 99 |
| TOTAL CFM/2 SIDES | 354166 | 395094 | 605226 | 660708 | 258307 | 353128 |
| COOLING RATE (DEG F./SEC) | 52.77 | 49.27 | 33.82 | 31.01 | 28.71 | 28.35 |

The system of the present invention need not be employed with two thermal exchange (cooling, heating, wiping, or drying) units but may in some instances be employed advantageously with a single unit. The benefits of the improved system of the invention will be provided in situations wherein efficient heat transfer from one side only is desired.

Other than for possible purposes of minimizing interference of gas flow where the nozzle array covers an area greater than the strip, it will generally be preferred that the volume and velocity of the gas emerging from the nozzles be substantially identical within one cooling unit. Also, those of one cooling unit may be substantially identical to those of another.

The method of the present invention involves providing such first and second cooling units 6, 8, passing the strip 2 in the path therebetween and passing cooling gas such as air through the cooling plenums and out the nozzles to impinge upon both sides of the strip. The gas is caused to flow into heat exchanging relationship with the surface of the strip and then to the spent gas recovery regions 50, 54 for ultimate exit out of the region between the two cooling units 6 and 8 by passing around the exterior of the nozzles and plenum. In general the spent gas will emerge from the system in a In the six test variations a number of parameters were employed in order to obtain accurate readings of cooling system efficiency. In tests 1 through 3, strips in widths of 72 inches and varying in thickness from about 0.03 to 0.04 inch were employed. As is apparent, the two stages of cooling effected efficient reduction in strip temperature of over 700° F.

If desired, the cooling units may be established in modules so that two or more modules may be employed on each side of the cooling system. For example, the cooling units may have a length of about 13 feet and a width of about 5 feet.

It will be appreciated, therefore, that the present invention has provided an efficient, compact, economical means for effecting cooling of moving metal strip in a uniform manner which involves the use of high velocity, low volume cooling gas such as air and regions for exhaust of the spent gas coming off of the strip in such a way as to preserve efficient, smooth flow. The nozzles are so dimensioned and positioned as to provide for efficient heat exchange effect with the strip, uniform distribution of turbulent flow on the surface of the strip, avoidance of damage to the strip by physical contact or by undesired induced strip vibrations and uniform distribution of the cooling gas over the strip. All of this may be accomplished within relatively small areas and thereby will facilitate retrofit as well as use in new plant construction.

While the system has been illustrated as having a pair of cooperating units 6, 8, it will be appreciated that in general a plurality of units or pairs of units disposed in end to end relationship, along the path of strip flow, will generally be employed.

It will be appreciated that as shown in FIGS. 1 through 3, the nozzles may have equal internal diameters within a unit. This is not essential. For example, as shown in FIG. 4 the uppermost and lowermost horizontal rows of nozzles containing respectively nozzles 106, 118 have smaller internal diameters than the other nozzles of the unit. For example, the larger nozzles may have an inside diameter of about 1½ inch and the smaller nozzle may have an inside diameter of about 1 inch.

While the invention has been disclosed in the context of a presently preferred use in connection with metal strip the invention is not so limited and may be employed with strip made from other materials such as in continuous plastic sheet extrusion, for example. While for simplicity of disclosure herein emphasis has been placed upon use of the system for strip cooling it will be apparent to those skilled in the art that the system may be employed for strip heating or drying as well as by merely altering the gas temperature and/or velocity. Also, the system may be employed for wiping a strip. Wiping may, for example, involve creating a gas induced shear force to remove a liquid film from the strip surface and transport it for discharge with the spent gas. The system may also be used to establish a strip stabilizing force to resist undesired aerodynamically induced strip vibration. All of those approaches will be deemed to be embraced by the expression "thermal exchange" and the units may be considered as "thermal treatment gas handling means."

Whereas particular embodiments of the invention have been described herein for purposes of illustration, it will be evident to those skilled in the art that numerous variations of the details may be made without departing from the invention as set forth in the appended claims.

I claim:

1. Apparatus for treating a strip comprising thermal treatment gas having means disposed in relative spaced relationship with respect to said strip, said thermal treatment gas handling means having a unit having a first hollow body portion of receipt and discharge of gas and a plurality of elongated first nozzle members extending therefrom toward said path, said thermal treatment gas handling means having a second unit cooperating with said first unit to provide a path for movement of said strip therbetween, said second unit having a hollow body portion for receipt and discharge of gas and a plurality of second elongated nozzle members extending therefrom toward said path, flow creating means for introducing gas into hollow body portions and out of said nozzle members, said nozzles of said first unit are generally axially aligned with the nozzles of said second unit, and said flow creating means having means for moving gas out of said nozzle members at a velocity of about 1,000 to 13,000 feet per minute.

2. The apparatus of claim 1, including said apparatus being metal strip treating apparatus, and said nozzles having an internal diameter of about 1 to 4 inches.

3. The apparatus of claim 2 including said first unit and said second unit being cooling gas supply units.

4. The apparatus of claim 2 including said first unit and said second unit having gas supply means for supplying at least one of heating, wiping or drying gas to said strip.

5. The cooling apparatus claim 3 including said nozzle members cooperating with adjacent portions of said first and second hollow body portions and said strip to define a pair of spent gas receiving regions, whereby undesired interference with gas emerging from said nozzle members by said spent gas will be resisted and said apparatus will cause said cooling gas to impinge on both sides of said metal strip to effect cooling thereof.

6. The cooling apparatus of claim 5 including said first nozzle members being disposed in a plurality of rows with nozzle members of adjacent said rows being in relative staggered relationship.

7. The cooling apparatus of claim 6 including said second nozzle members being disposed in a plurality of rows with nozzle members of adjacent said rows being in relative staggered relationship.

8. The cooling apparatus of claim 7 including said first and second nozzle members being of generally circular cross-sectional configuration.

9. The cooling apparatus of claim 8 including said first and second nozzle members being oriented generally perpendicularly with respect to said path.

10. Apparatus for treating a strip comprising thermal treatment gas having means disposed in relative spaced relationship with respect to said strip, said thermal treatment gas handling means having a unit having a first hollow body portion for receipt and discharge of gas and a plurality of elongated first nozzle members extending therefrom towered said path, flow creating means for introducing gas into hollow body portions and out of said nozzle members, said apparatus being metal strip treating apparatus, said first unit and said second unit being cooling gas supply units, said first unit and said second unit having heating, wiping, or drying gas supply units, flow creating means for introducing gas into hollow body portions and out of said nozzle members, said nozzle member cooperating with adjacent portions of said first and second hollow body portions and said strip to define a pair of spent gas receiving regions, whereby undesired interference with gas emerging from said nozzle members by said spent gas will be resisted and said apparatus will cause said cooling gas to impinge on both of said metal strip to effect cooling thereof, said first nozzle members being disposed in a plurality of rows with nozzle members of adjacent said rows being in relative staggered relationship, said second nozzle members being disposed in a plurality of rows with nozzle members of adjacent said rows being in relative staggered relationship, said first and second nozzle members being of generally circular cross-sectional configuration, said first and second nozzle members being oriented generally perpendicularly with respect to said path, and said first and second nozzle members having a length of about 3 to 12 inches.

11. The cooling apparatus of claim 10 including said first and second nozzle members having free ends spaced about about 3 to 7 times the nozzle internal diameter from said path.

12. The cooling apparatus of claim 11 including said apparatus having a plurality of said first units and a plurality of said second units.

13. Apparatus for cooling a strip comprising said apparatus being metal strip treating apparatus, thermal treatment gas handling means disposed in relative spaced relationship with respect to said strip, said thermal treatment gas handling means having a unit with a first hollow body portion for receipt and discharge of gas and a plurality of elongated first nozzle members extending therefrom toward said path, flow creating means for introducing gas into hollow body portions and out of said nozzle members, said thermal treatment gas handling means having a second unit cooperating with said first unit to provide a path for movement of said strip therebetween, said second unit having a hollow body portion for receipt and discharge of gas and a plurality of second elongated nozzle members extending therefrom toward said path, said first unit and said second unit being cooling gas supply units, said nozzle members cooperating with adjacent portion of said first and second hollow body portions and said strip to define a pair of spent gas receiving regions, whereby undesired interference with gas emerging from said nozzle members by said spent gas will be resisted and said apparatus will cause said cooling gas to impinge on both sides of said metal strip to effect cooling thereof, said first nozzle members being disposed in a plurality of rows with nozzle members of adjacent said rows being in relative staggered relationship, said second nozzle members being disposed in a plurality of rows with nozzle members of adjacent said rows being in relative staggered relationship, said first and second nozzle members being of generally circular cross-sectional configuration, said first and second nozzle members being oriented generally perpendicularly with respect to said path, said first and second nozzle members having a length of about 3 to 12 inches, said first and second nozzle members having free ends spaced about 3 to 7 times the nozzle internal diameter from said path, and said apparatus having a plurality of said first units and a plurality of said second units.

14. The cooling apparatus of claim 13 including said cooling apparatus being apparatus for cooling galvanized steel strip.

15. The cooling apparatus of claim 14 including said flow creating means having means for moving said gas at a velocity of about 8,000 to 13,000 feet per minute.

16. The cooling apparatus of claim 3 including said nozzle members within a said row having a center-to-center spacing of about 4 to 5 times the nozzle internal diameter.

17. The cooling apparatus of claim 16 including each of said first and second cooling units having about 100 to 250 nozzle members.

18. The cooling apparatus of claim 5 including said spent gas receiving regions being so disposed as to facilitate withdrawal of heat from the exterior surfaces of said nozzles and adjacent plenum surfaces by said spent gas.

19. A method of treating a strip of material comprising providing thermal treatment gas handling means with a first unit having a plenum in communication with a plurality of first elongated nozzle members projecting therefrom for directing gas onto said strip as it moves in a path adjacent to said thermal treatment gas handling means, moving said strip in said path, directing said gas through said first unit plenum and out of the nozzle elements onto a first side of said strip, effecting exhaust of said gas after it has contracted said strip through spent gas recovery regions defined by the exterior surfaces of nozzle elements and a wall of said unit, whereby said gas will flow from said nozzle elements to said strip and subsequently through said spent gas recovery region, effecting said air flow out of said nozzle elements at a velocity of about 1,000 to 13,000 feet per minute, providing said thermal treatment gas handling means with a second unit having a hollow body portion for receipt and discharge of gas and a plurality of second elongated nozzle members projecting therefrom for directing gas onto said strip, and positioning said second unit on the opposite side of said path from said first unit and positioning said second unit with its nozzles generally axially with the nozzles of said first unit and directing gas through such second nozzle members onto a second side of said strip, and positioning the nozzle element discharge ends about 3 to 7 times the nozzle internal diameter from said path.

20. The method of claim 19, including treating galvanized metal strip by said method.

21. The method of claim 20 including employing said method to cool said strip.

22. The method of claim 21 including employing said method to heat, wipe, or dry said strip.

23. A method of cooling treating strip comprising providing thermal treatment gas handling means with a first unit having a plenum in communication with a plurality of first elongated nozzle members projecting therefrom for directing gas onto said strip as it moves in a path adjacent to said thermal treatment gas handling means, moving said strip in said path, directing said gas through said first unit plenum and out of the nozzle elements onto a first side of said strip, providing said thermal treatment gas handling means with a second unit having a hollow body portion for receipt and discharge of gas and a plurality of second elongated nozzle members projecting therefrom for directing gas onto said strip, positioning said second unit on the opposite side said of said path from said first unit and directing gas through such second nozzle members onto a second side of said strip, effecting exhaust of said gas after it has contacted said strip through spent gas recovery regions defined by the exterior surfaces of nozzle elements and a wall of said unit, whereby said gas will flow from said nozzle elements to said strip and subsequently through said spent gas recovery region, treating metal strip by said method, employing said method to cool said strip, and cooling said strip from about 1,000° F. or more to about 350° F. or less.

24. The cooling method of claim 23 including employing air as said cooling gas.

25. The cooling method of claim 24 including providing said nozzle elements with a receiving end in communication with said plenums and discharge ends, and positioning said nozzle element discharge ends about 3 to 7 times the nozzle internal diameter from said path.

26. The cooling method of claim 25 including establishing the flow of said air emerging from said nozzle in a direction generally perpendicular to said strip path.

27. The cooling method of claim 26 including employing nozzle elements having a length of about 3 to 12 inches.

28. The cooling method of claim 26 including employing nozzle elements having a generally circular cross-sectional configuration.

29. The cooling method of claim 28 including effecting said air flow out of said nozzle elements at a velocity of about 1,000 to 13,000 feet per minute.

30. The cooling method of claim 29 including supplying a generally equal velocity of air from the nozzle elements of the first cooling unit and the nozzle elements of the second cooling unit.

31. A method of cooling strip comprising providing thermal treatment gas handling means with a first unit having a plenum in communication with a plurality of first elongated nozzle members projecting therefrom for directing gas onto said strip as it moves in a path adjacent to said thermal treatment gas handling means, moving said strip in said path, directing said gas through said first unit plenum and out of the nozzle elements onto a first side of said strip, providing said thermal treatment gas handling means with a second unit having a hollow body portion for receipt and discharge of gas and a plurality of second elongated nozzle members projecting therefrom for directing gas onto said strip, positioning said second unit on the opposite side of said path from said first unit and directing gas through such second nozzle members onto a second side of said strip, effecting exhaust of said gas after it has contracted said strip through spent gas recovery regions defined by the exterior surfaces of nozzle elements and a wall of said unit, whereby said gas will flow from said nozzle elements to said strip and subsequently through said spent gas recovery region, treating metal strip by said method, employing said method to cool said strip, cooling said strip from about 1,000° F. or more to about 350° F. or less, employing air as said cooling gas, providing said nozzle elements with a receiving end in communication with said plenum and discharge ends, positioning said nozzle element discharge ends about 3 to 7 times the nozzle internal diameter from said path, establishing the flow of said air emerging from said nozzle in a direction generally perpendicular to said strip path, employing nozzle elements having a length of about 3 to 12 inches, employing nozzle elements having a generally circular cross-sectional configuration, effecting said air flow out of said nozzle elements at a velocity of about 1,000 to 13,000 feet per minute, supplying a greater velocity of air from at least some of the nozzle elements of the first cooling unit than the nozzle elements of the second cooling unit.

32. The cooling method of claim 31 including effecting said air flow out of said nozzle element at a velocity of about 8,000 to 13,000 cubic feet per minute.

33. The cooling method of claim 31 including employing said nozzle elements in a steel galvanizing process.

34. The cooling method of claim 31 including employing nozzle elements with an internal diameter of about 1 to 4 inches.

35. The cooling method of claim 31 including providing said nozzle elements in rows, and staggering the said nozzle elements in one row with respect to the nozzle elements in an adjacent row on said cooling units.

36. The cooling method of claim 31 including establishing said nozzle elements with a said row with a center to center spacing of about 4 to 5 times the nozzle internal diameter.

37. The cooling method of claim 31 including employing said cooling gas at ambient temperature.

38. The cooling method of claim 31 including effecting said cooling with the nozzles of said first cooling unit being generally axially aligned with the nozzles of said second cooling unit.

39. The method of claim 31 including removing heat from the exterior surfaces of said nozzles by flow of said spent gas thereby.

40. The method of claim 39 including removing heat from exterior surfaces of said plenum by flow of said spent gas thereby.

41. The method of claim 31 including providing a plurality of said first units and a plurality of said second units.

42. A method of treating a strip of material comprising providing thermal treatment gas handling means with a first unit having a plenum in communication with a plurality of first elongated nozzle members projecting therefrom for directing gas onto said strip as it moves in a path adjacent to said thermal treatment gas handling means, moving said strip in said path, directing said gas through said first unit plenum and out of the nozzle elements onto a first side of said strip, providing said thermal treatment gas handling means with a second unit having a hollow body portion for receipt and discharge of gas and a plurality of second elongated nozzle members projecting therefrom for directing gas onto said strip, positioning said second unit on the opposite side of said path from said first unit and directing gas through such second nozzle members onto a second side of said strip, effecting exhaust of said gas after it has contacted said strip through spent gas recovery regions defined by the exterior surfaces of nozzle elements and a wall of said unit, whereby said gas will flow from said nozzle elements to said strip and subsequently through said spent gas recovery region, providing a plurality of said first units and a plurality of said second units, and employing said units to resist undesired strip vibration by employing different gas flow velocity out of some nozzles than velocity out of other nozzles.

43. The method of claim 42 including resisting said undesired vibrations by varying said gas flow velocity between a pair of cooperating units.

44. The method of claim 42 including resisting said undesired vibrations by terminating said gas flow in at least one said unit.

* * * * *

UNITED STATES PATENT AND TRADEMARK OFFICE

CERTIFICATE OF CORRECTION

PATENT NO. : 5,201,132

DATED : April 13, 1993

INVENTOR(S) : WILLIAM L. JACOB

It is certified that error appears in the above-identified patent and that said Letters Patent is hereby corrected as shown below:

Claim 1, column 9, line 46, "having" should be --handling--.

Claim 1, column 9, line 50, "of" should be --for--.

Claim 10, column 10, line 37, "having" should be --handling--.

Claim 10, column 10, line 42, "towered" should be --toward--.

Claim 10, column 10, line 53, "member" should be --members--.

Claim 10, column 10, line 59, --sides-- should be inserted after "both".

Claim 13, column 11, line 35-36, the first occurrence of "portion" should be --portions--.

UNITED STATES PATENT AND TRADEMARK OFFICE

CERTIFICATE OF CORRECTION

PATENT NO. : 5,201,132

DATED : April 13, 1993

INVENTOR(S) : WILLIAM L. JACOB

It is certified that error appears in the above-identified patent and that said Letters Patent is hereby corrected as shown below:

Claim 19, column 12, line 24, "contracted" should be --contacted--.

Claim 19, column 12, line 39, --aligned-- should be inserted after "axially".

Claim 23, column 13, line 1, the second occurrence of "said" should be deleted.

Claim 31, column 13, line 61, "contracted" should be --contacted--.

Claim 31, column 14, line 5, "plenum" should be --plenums--.

Signed and Sealed this

Third Day of January, 1995

Bruce Lehman

*Attest:*

BRUCE LEHMAN

*Attesting Officer*

*Commissioner of Patents and Trademarks*